United States Patent [19]

Laverion

[11] Patent Number: 4,984,968

[45] Date of Patent: Jan. 15, 1991

[54] VARIABLE PITCH PROPELLERS

[75] Inventor: Bernard H. M. Laverion, Soevik, Norway

[73] Assignee: Ulstein Propeller A/S, Norway

[21] Appl. No.: 431,090

[22] Filed: Nov. 3, 1989

[51] Int. Cl.[5] ..... A47C 7/74

[52] U.S. Cl. ..... 416/146 A; 277/58; 277/206 R; 384/904; 416/207

[58] Field of Search ..... 416/146 A, 207, 147; 277/58, 206 R; 384/904

[56] References Cited

U.S. PATENT DOCUMENTS

| | | | |
|---|---|---|---|
| 2,436,612 | 2/1948 | Sheets | 416/207 |
| 3,389,920 | 6/1968 | Allan et al. | 416/207 |
| 3,794,440 | 2/1974 | McMurtry | 416/146 A |
| 4,022,543 | 5/1977 | Göransson | 416/207 |

*Primary Examiner*—William E. Wayner

*Attorney, Agent, or Firm*—Bacon & Thomas

[57] ABSTRACT

An improvement in a variable pitch propeller to allow replacement of propeller blades under water without water intruding into the mechanism in the propeller hub and without a substantial quantity of oil leaking to the surrounding water. The propeller comprises a number of turnable propeller blades (2) which are each removably attached to a rotatable crank disk (3) and for each propeller blade there is provided a first seal (5) between the hub (1) and the propeller blade root (2*a*), a second seal (6) between the hub (1) and the crank disk (3) and a by-pass valve (7) passing the second seal (6). the valve (7) is spring biased to remain in a closed position when the propeller blade (2) is removed. When the propeller blade (2) is secured in place the first seal (5) is operative and when the propeller blade is removed, the second seal (6) is the operative one together with the valve (7).

2 Claims, 1 Drawing Sheet

VARIABLE PITCH PROPELLERS

BACKGROUND OF THE INVENTION

The present invention relates to an improvement in variable pitch propellers, through which it will be possible to replace a propeller blade under water without water intruding into the mechanism in the propeller hub and without a substantial quantity of oil leaking to the surrounding water.

A variable pitch propeller comprises a propeller hub and a number of propeller blades which may be turned and which are each removably attached to a crank disk which, in turn, is connected to an adjusting mechanism. The interior of the hub is filled with oil, and a seal is provided between the hub and the blade root of each propeller blade to prevent water from entering the hub and from damaging the adjusting mechanism. Further, the seal should prevent oil, present between the blade root and the adjacent "seating" in the hub to provide for lubrication, from leaking out to the surroundings.

Means have been suggested previously whereby a disk is located between the blade root and the seal which disk remains in its place and retains the sealing function when the blade is removed. This disk does, however, occupy space which could otherwise be utilized to provide optimal mechanical strength in hub and propeller blades. This sealing disk does consequently either involve a weakening of the structure or an undesired increase of the hub diameter along with substantial excess costs.

SUMMARY OF THE INVENTION

The invention concerns an improvement in a variable pitch propeller for the purpose stated above, comprising a propeller hub and a number of propeller blades which may be turned and which are each removably attached to a rotatable crank disk. A unique feature of the invention exists in the use, for each propeller blade of a, first seal between the hub and the propeller blade root, a second seal between the hub and the crank disk and a by-pass valve by-passing the second seal. The by-pass valve is preferably biased, e.g. by means of a spring, to be in closing position when the propeller blade is removed.

BRIEF DESCRIPTION OF THE DRAWINGS

The invention shall be closer described with reference to the accompanying drawing, in which.

DETAILED DESCRIPTION OF A PREFERRED EMBODIMENT

Figure 1:
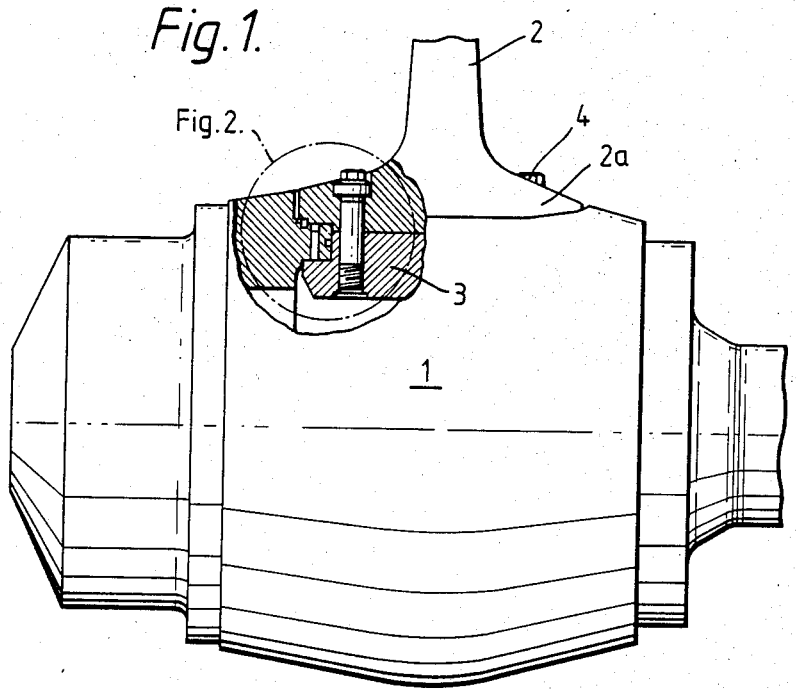
FIG. 1 shows, partly in section and with some parts removed for the sake of clarity, a variable pitch propeller arrangement in agreement with the present invention.

The drawing shows a variable pitch propeller having a propeller hub 1 and a number of turnable propeller blades 2, of which only one is shown. The propeller blade 2 is removably attached to a rotatable crank disk 3 in such a manner that an annular groove is formed between the blade root 2*a* of the propeller blade and the crank disk 3, the lateral faces of said groove enclosing a radially inwardly extending flange in the hub. The crank disk 3 is in a manner known per se connected to a servo mechanism for adjustment of the pitch of the propeller blade 2. During operation of the propeller, a lubricating oil will be present between the blade root 2*a* and the seating surface on the inwardly extending flange in order to facilitate adjustment of the propeller blade pitch. The propeller blade is attached to the crank disk by means of a number of securing bolts 4.

Figure 2:
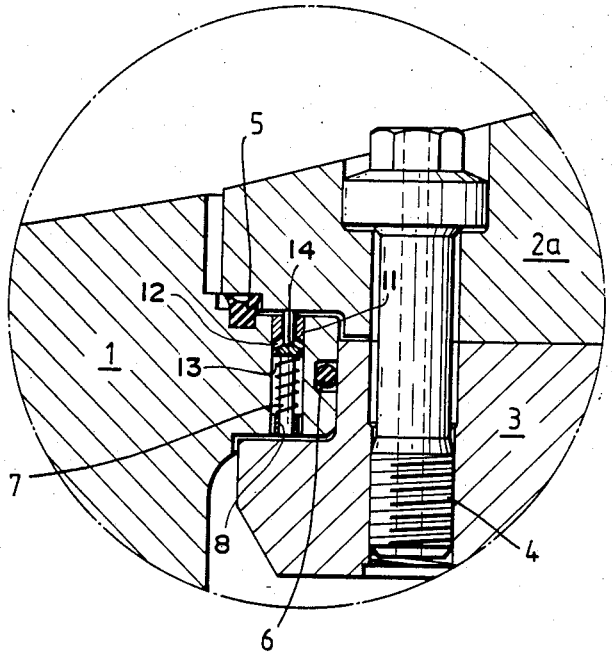
FIGS. 2 and 3 show the encircled sectioned portion of FIG. 1 at a larger scale and in two conditions for the propeller blade, viz. attached and removed, respectively.
Figure 3:
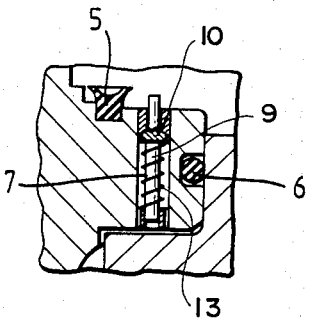

In order to permit removal of a propeller blade under water without water entering into the hub and without oil leaking out in the surrounding water, the propeller of the present invention is provided with a first seal 5 between the blade root 2*a* and the hub 1 and a second seal 6 between the crank disk 3 and the hub, as well as a by-pass valve 7 passing the second seal 6. By-pass valve 7 is actually located in a bore 8 provided in hub 1. By-pass valve 7 includes a pin 9 having a head 10 which, in its closed position, is sealed against seat 11 (FIG. 3) and, in its open position, permits the flow of lubricating oil through slots 12 (FIG. 2). Head 10 is normally biased to a closed position by means of spring 13. When blade root 2*a* and crank disk 3 are bolted together, a portion of the blade root 2*a* engages an end 14 of pin 9 which extends beyond the outer surface of hub 1 and moves head 10 away from seat 11 in order to permit the flow of oil. Normally, with the propeller blade 2 attached to the respective crank disk 3 the first seal 5 is the operative one, the valve 7 in this condition of the propeller blade being open (FIG. 2). Lubricating oil may consequently flow from the hub to the seating surface of the propeller blade, unhindered by the second seal 6.

When the propeller blade 2 is detached and removed, e.g. for replacement or repair, the valve 7 will be closed and the second seal 6 becomes operative (FIG. 3) and prevents together with the closed by-pass valve 7 oil from flowing to the now exposed outer side of the crank disk 3 and water from entering into the hub.

When a new or repaired propeller blade is placed in position, the valve is opened and oil will flow to the bearing face between propeller blade and hub, and the oil will displace water from the region inside the first seal until the propeller blade 2 is securely fastened by means of the appurtenant propeller blade bolts 4.

I claim:

1. An improvement in variable propellers having a propeller hub (1) and a number of turnable propeller blades (2) which are each removably attached to a rotatable crank disk (3), said improvement comprising, for each propeller blade (2), a first seal (5) between the hub (1) and a respective propeller blade root (2*a*), a second seal (6) between the hub (1) and the crank disk (3) and a by-pass valve (7) passing the second seal (6).

2. An improvement in variable pitch propellers as claimed in claim 1 wherein the by-pass valve (7) is biased to a closed position when the propeller blade (2) is removed.

* * * * *